US008157754B2

(12) United States Patent
Weintraub et al.

(10) Patent No.: US 8,157,754 B2
(45) Date of Patent: Apr. 17, 2012

(54) PORTABLE DEVICE FOR THE ENHANCEMENT OF CIRCULATION AND FOR THE PREVENTION OF STASIS RELATED DVT

(76) Inventors: David Weintraub, Yavne (IL); Yuval Avni, Givatayim (IL)

( * ) Notice: Subject to any disclaimer, the term of this patent is extended or adjusted under 35 U.S.C. 154(b) by 1904 days.

(21) Appl. No.: 10/469,685

(22) PCT Filed: Mar. 3, 2002

(86) PCT No.: PCT/IL02/00157

§ 371 (c)(1),
(2), (4) Date: Sep. 3, 2003

(87) PCT Pub. No.: WO02/069879

PCT Pub. Date: Sep. 12, 2002

(65) Prior Publication Data

US 2004/0073146 A1 Apr. 15, 2004

(30) Foreign Application Priority Data

Mar. 5, 2001 (IL) ..... 141824

(51) Int. Cl.
*A61H 7/00* (2006.01)

(52) U.S. Cl. ..... 601/134; 601/143; 601/144

(58) Field of Classification Search ..... 601/134, 601/143–144; 602/13

See application file for complete search history.

(56) References Cited

U.S. PATENT DOCUMENTS

| | | | | |
|---|---|---|---|---|
| 443,204 | A * | 12/1890 | Davis | 601/41 |
| 718,766 | A | 1/1903 | Ingram | |
| 2,118,699 | A | 5/1938 | Chappell | |
| 2,441,394 | A | 5/1948 | Bucy | |
| 2,754,817 | A | 7/1956 | Nemeth | |
| 3,804,084 | A | 4/1974 | Lehman | |
| 3,853,121 | A | 12/1974 | Mizrachy et al. | |
| 4,004,579 | A | 1/1977 | Dedo | |
| 4,206,765 | A * | 6/1980 | Huber | 600/490 |
| 4,243,039 | A | 1/1981 | Aginsky | |
| 4,333,181 | A | 6/1982 | Corriero | |
| 4,396,010 | A | 8/1983 | Arkans | |
| 4,732,140 | A | 3/1988 | Stoffregen | |
| 4,770,164 | A | 9/1988 | Lach et al. | |
| 4,928,674 | A | 5/1990 | Haperin et al. | |
| 4,982,732 | A | 1/1991 | Morris | |
| 5,009,222 | A | 4/1991 | Her | |
| 5,277,697 | A | 1/1994 | France et al. | |
| 5,334,131 | A | 8/1994 | Spector et al. | |
| 5,399,153 | A | 3/1995 | Caprio et al. | |
| 5,407,418 | A | 4/1995 | Szpur | |
| 5,454,831 | A | 10/1995 | McEwen | |
| 5,468,218 | A | 11/1995 | Ward | |
| 5,472,413 | A | 12/1995 | Detty | |

(Continued)

FOREIGN PATENT DOCUMENTS

| | | |
|---|---|---|
| CH | 187 824 | 11/1936 |

(Continued)

*Primary Examiner* — Michael A. Brown

(57) ABSTRACT

The present invention provides a portable device and method for enhancing blood flow in a limb and for reducing the risk of Deep Vein Thrombosis (DVT) formation by applying periodic squeezing forces on a limb, in particular a lower limb. The device comprises a flask-like casing box and a strap connected to opposite sides of said casing such as to form a closed loop around the limb. Said box contains machinery for actuating periodical change in the circumference of said closed loop between a contracted and a relaxed positions.

29 Claims, 10 Drawing Sheets

U.S. PATENT DOCUMENTS

| | | | | |
|---|---|---|---|---|
| 5,513,658 | A | 5/1996 | Goseki | |
| 5,575,761 | A * | 11/1996 | Hajianpour | 601/48 |
| 5,738,637 | A | 4/1998 | Kelly et al. | |
| 5,769,801 | A | 6/1998 | Tumey et al. | |
| 5,865,776 | A | 2/1999 | Springs | |
| 5,873,848 | A | 2/1999 | Fulkerson | |
| 6,010,470 | A | 1/2000 | Albery et al. | |
| 6,135,116 | A | 10/2000 | Vogel et al. | |
| 6,174,295 | B1 | 1/2001 | Cantrell et al. | |
| 6,231,532 | B1 | 5/2001 | Watson et al. | |
| 6,290,662 | B1 * | 9/2001 | Morris et al. | 601/149 |
| 6,478,757 | B1 | 11/2002 | Barak | |
| 6,494,852 | B1 | 12/2002 | Barak et al. | |
| 6,551,280 | B1 | 4/2003 | Knighton et al. | |
| 6,616,620 | B2 | 9/2003 | Sherman et al. | |
| 6,780,163 | B1 | 8/2004 | Krusenklaus | |
| 7,004,919 | B2 | 2/2006 | Gaylord et al. | |
| 7,025,738 | B2 | 4/2006 | Hall | |
| 2002/0026131 | A1 | 2/2002 | Halperin | |
| 2002/0042583 | A1 | 4/2002 | Barak et al. | |
| 2002/0169399 | A1 | 11/2002 | Rastegar et al. | |
| 2002/0177793 | A1 | 11/2002 | Sherman | |
| 2005/0027218 | A1 | 2/2005 | Filtvedt et al. | |
| 2005/0043657 | A1 | 2/2005 | Couvillon, Jr. | |
| 2005/0267387 | A1 | 12/2005 | Baldauf et al. | |
| 2006/0009720 | A1 | 1/2006 | Chung | |
| 2006/0047232 | A1 | 3/2006 | Bourne et al. | |
| 2006/6074362 | | 6/2006 | Rousso et al. | |
| 2006/9122546 | | 6/2006 | Rousso | |
| 2007/0055188 | A1 | 3/2007 | Avni | |
| 2007/0173886 | A1 | 7/2007 | Rousso et al. | |
| 2007/0270725 | A1 | 11/2007 | Sherman et al. | |
| 2008/0015630 | A1 | 1/2008 | Rousso | |
| 2008/0039752 | A1 | 2/2008 | Rousso | |
| 2008/0097268 | A1 | 4/2008 | Rousso | |
| 2008/0146980 | A1 | 6/2008 | Rousso et al. | |
| 2008/0255494 | A1 | 10/2008 | Rousso et al. | |
| 2008/0269543 | A1 | 10/2008 | Rousso | |
| 2009/0118651 | A1 | 5/2009 | Rousso et al. | |

FOREIGN PATENT DOCUMENTS

| | | | |
|---|---|---|---|
| CH | 187 824 | A | 11/1936 |
| DE | 19815487 | | 10/1999 |
| JP | 2001/198170 | | 7/2001 |
| WO | 97 04820 | A | 2/1997 |
| WO | WO 97/04820 | | 2/1997 |
| WO | WO97/04820 | | 3/1997 |
| WO | WO00/23034 | | 4/2000 |
| WO | 00 27334 | A | 5/2000 |
| WO | WO 00/27334 | | 5/2000 |
| WO | 01 32124 | A | 5/2001 |
| WO | WO 01/32124 | | 5/2001 |
| WO | WO01/91364 | | 11/2001 |
| WO | WO 2005/051250 | | 6/2005 |
| WO | WO 2005/072674 | | 8/2005 |
| WO | WO 2005/074376 | | 8/2005 |
| WO | WO 2005/120424 | | 12/2005 |
| WO | WO2005/120500 | | 12/2005 |
| WO | WO2005/122269 | | 12/2005 |
| WO | WO2006/033114 | | 3/2006 |
| WO | WO2006/033115 | | 3/2006 |
| WO | WO2006/035449 | | 4/2006 |
| WO | WO2006/117771 | | 11/2006 |

* cited by examiner

PORTABLE DEVICE FOR THE ENHANCEMENT OF CIRCULATION AND FOR THE PREVENTION OF STASIS RELATED DVT

BACKGROUND OF THE INVENTION

1. Field of the Invention

The present invention generally relates to enhancement of blood and lymph flow in a limb and the prevention of Deep Vein Thrombosis (DVT). More specifically, the present invention relates to a portable, self contained, mechanical device for enhancing the blood in a limb, enhancing the lymph and venous return from a limb, specifically a lower limb, towards the heart, aiming at reducing the risk of DVT formation, edema formation and improving the general circulation in a limb during periods of immobility.

2. Discussion of the Related Art

The development of a "blood clot" or Deep Vein Thrombosis (DVT) in a limb, specifically in the lower limbs, is a major health hazard. It may lead to local symptoms and signs such as redness, pain and swelling of the affected limb. It may also be a life hazard by sending small parts of a blood clot towards the lungs corking the circulation through the lungs (called Pulmonary Embolism), leading to reduced ability of the lungs and sometimes of the heart to function. This is accompanied by pain, shortness of breath, increased heart rate and other clinical signs and symptoms.

The development of DVT is believed to be related pathologically to Virchow's triad. More specifically, a DVT has increased incidence if three conditions are met in the vasculature; Stasis (reduced blood flow), Hypercouagulability (increased tendency of clotting in a blood vessel during normal conditions) and Endothelial damage (damage to the internal layer of the blood vessel promotes clot formation).

In the ambulatory person the muscles of the leg compress the deep venous system of the leg pushing the blood towards the heart. This phenomena is called the "muscle pump". The muscles of the calf are traditionally implicated in the mechanism of the "muscle pump".

During period of immobilization, stasis is believed to be the major risk factor for the formation of DVT. Immobilization includes any period of lack of physical activity whether in the supine or sitting position e.g. bed or chair ridden persons, during long automobile trips, long flights, long working hours in the sitting position etc.

Recently the medical community named the formation of DVT during long journeys, the "travelers thrombosis". It is believed that around 5% of manifested DVT originate during traveling. This is believed to occur due to the prolonged immobilization, especially while in the sitting position. This position further compromises blood flow due to kinking of veins in the limb during the sitting position. It was further shown that enhancing the venous blood flow (via a compressing device) during flight, reduced discomfort, limb swelling, fatigue and aching when used on flight attendants.

Limb swelling and discomfort may be present also in states of lymph stasis such as after a mastectomy and in other conditions in which lymphatic return to the heart is impaired.

Increasing the flow of blood in the limb during periods of immobility is already a proven method to prevent the formation of DVT in the limb. It secondarily prevents the formation of pulmonary embolism (PE) that commonly originates from a DVT. Increasing the venous return from the lower limb can also prevent formation of edema, pain and discomfort in the limb during periods of immobilization.

Prevention of DVT related to stasis is commonly achieved via large and cumbersome devices. Most of these devices can be used only by trained medical staff. Such devices operate by either of two methods: Pneumatic/Hydraulic intermittent compressions or by direct intermittent electrical stimulation of the "muscle pump". The Pneumatic/hydraulic devices use a sleeve or cuff with a bladder that is inflated and deflated by air or fluid compressor thus causing stimulation of the physiological "muscle pump". The pneumatic/hydraulic devices usually require a sophisticated set of tubes and valves, a compressor, a source of fluid and a sophisticated computer control. Moreover such devices emit substantial noise while operating. The electrical stimulators work by delivering electrical impulses to the calf muscles. These devices require a sophisticated electronic apparatus and may be painful or irritating to patient.

Most existing devices aimed at preventing DVT are designed for use in the medical setting, by trained personal. Such devices are generally non-portable.

Accordingly it is the object of the present invention to provide a device for the enhancement of blood and lymph flow in a limb and the prevention of DVT development during periods of immobility which simulate intermittent muscle compression of a limb and is portable, self-contained, does not relay on, but is compatible with, external power source, and is easily carried, small, and lightweight.

It is a further object of the present invention to provide such a device which is simple to operate by a lay person without any special training in the field of medicine, is easily strapped over or attached to a limb and can be easily be adjusted to fit persons of any size.

Another object of the present invention is to provide such a device for the prevention of DVT which does not involve air compression and which operates silently, thus allows its operation in a populated closed space, such as during a flight, without causing any environmental noise annoyance.

Yet it is another object of the present invention is to provide the intermittent muscle compression by mechanical means, more specifically by transforming energy, electrical or magnetic, into mechanical activity via a system of rods and wheels.

A further object of the present invention is to provide such a device for the prevention of DVT that is easy to manufacture and is low cost.

SUMMARY OF THE PRESENT INVENTION

In accordance with the above objects, the present invention provides a portable device and method for enhancing blood and lymph flow in a limb and for reducing the risk of Deep Vein Thrombosis formation by applying periodic squeezing forces on a limb, in particular a lower limb.

The device of the present invention is a small, portable, simple, mechanical device that produces intermittent mechanical compression of the deep venous system in a limb, more specifically the lower limb, by converting energy, more specifically electrical or magnetic energy into mechanical compressions, more specifically via strap compression or plate compression by the use of rods and wheel mechanical apparatus.

The present device comprises a casing box, preferably a flask-like curved box for fitting the curvature of the limb, and a strap connected by its two ends to opposite sides of said casing box such as to form a closed loop around the limb. The casing box contains a power source means, a motor powered by said power source means and a mechanical means coupled to said motor for actuating periodical change in the circumference of said closed loop between a contracted and a relaxed positions. Said periodical change in the circumference of said closed loop is obtained either by intermittently pulling and releasing at least one end of the strap toward the casing or by intermittently extending and retracting a compressive plate positioned between the casing and the limb. The periodical transition between the contracted and relaxed positions may be controlled such as to allow different time periods in each position. Preferably, a cycle comprises a fast contraction, followed by much longer period of relaxation. The device further comprises adjustments means for adjusting the circumference of the loop to the circumference of said limb.

Preferably the device further comprises regulation means for regulating the frequency of said periodical change and for regulating the length interval between said contracted and relaxed positions of said loop.

BRIEF DESCRIPTION OF THE DRAWINGS

The present invention will be understood and appreciated more fully from the following detailed description taken in conjunction with the drawings in which.

DETAILED DESCRIPTION OF PREFERRED EMBODIMENTS

A device for the intermittent compression of the extremities muscles for the enhancement of blood and lymph flow in a limb and the prevention of Deep Vein Thrombosis is disclosed.

Figure 1:
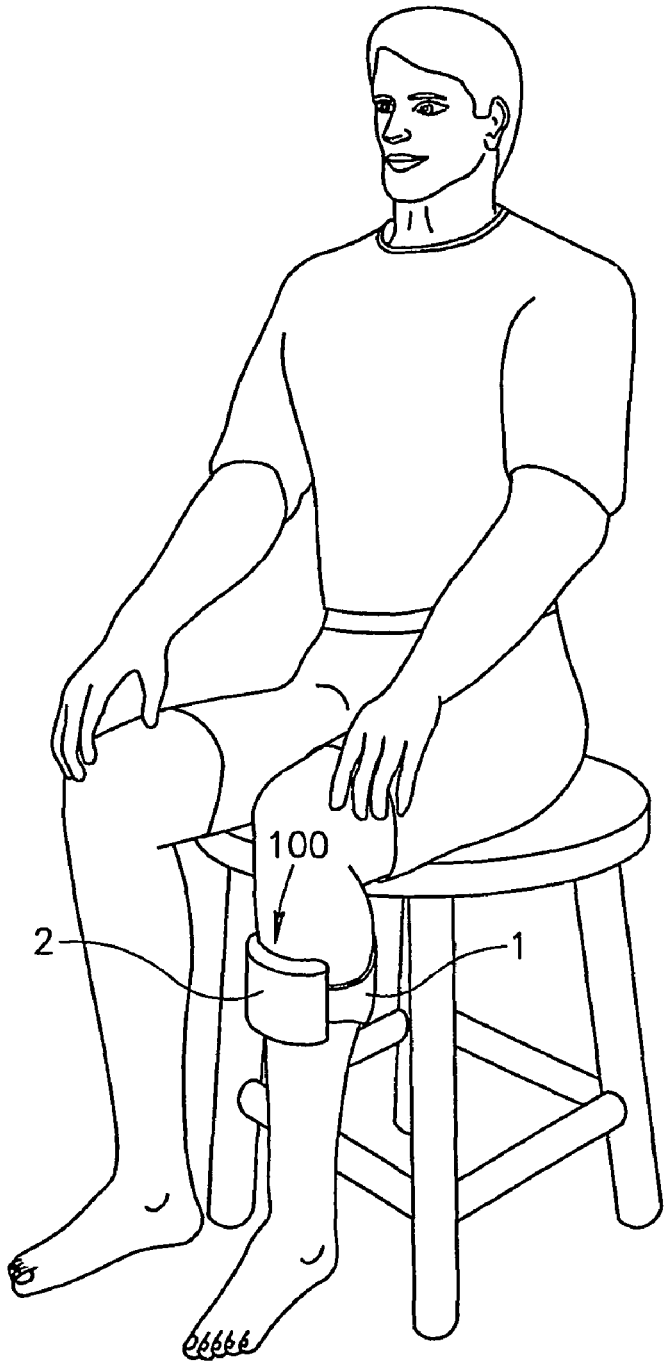
FIG. 1 is a pictorial illustration of the device of the present invention strapped to the calf of a sitting person.

The portable device of the present invention, generally designated 100, is shown in FIG. 1, worn on the calf of a sitting person, Device 100 can be worn directly on the bare limb, or on a garment, such as trousers, worn by the person using the device.

Device 100 comprises two main components, an assembly box 2 which contains all the machinery parts responsible for the device operation, and a strap 1 connected to said assembly box such as to form a closed loop (designated 50, see FIG. 2) for encircling a person limb. The power supply for the device may be of the internal power supply type such as a rechargeable or non rechargeable low voltage DC batteries or an external power supply type such as an external power outlet connected via an AC/DC transformer such as a 3-12V 1 Amp transformer, fed through electrical wires to a receptacle socket in the device (not shown).

As shown in FIG. 1, strap 1 is preferably wide in the middle and narrow at the ends where it connects to assembly box 2. Strap 1 however may assume any other shape and form such as a constant width belt. The strap can be fabricated from any flexible material that is non-irritating to the skin, such as thin plastic, woven fabric and the like. Strap 1 can be fabricated from one material or alternatively can combine more than one material. For example, strap 1 can be made of both non stretchable material and stretchable material wherein such an arrangement may be dispose of a stretchable material for example rubber fabric in the center of the strap 1 and a non stretchable material such as plastic flanking the stretchable material and comprising the rest of the strap. Such an arrangement facilitates a more uniform stretch forces on the strap as well as preventing the slippage of the strap from the limb.

According to the preferred embodiment shown in FIG. 1, hereinafter called the anterior box embodiment, strap 1 is placed against the muscles while assembly box 2 is placed against the calf bone. However, according to another embodiment of the present invention, hereinafter called the posterior box embodiment, assembly box 2 can be placed against the muscles.

Figure 2A:
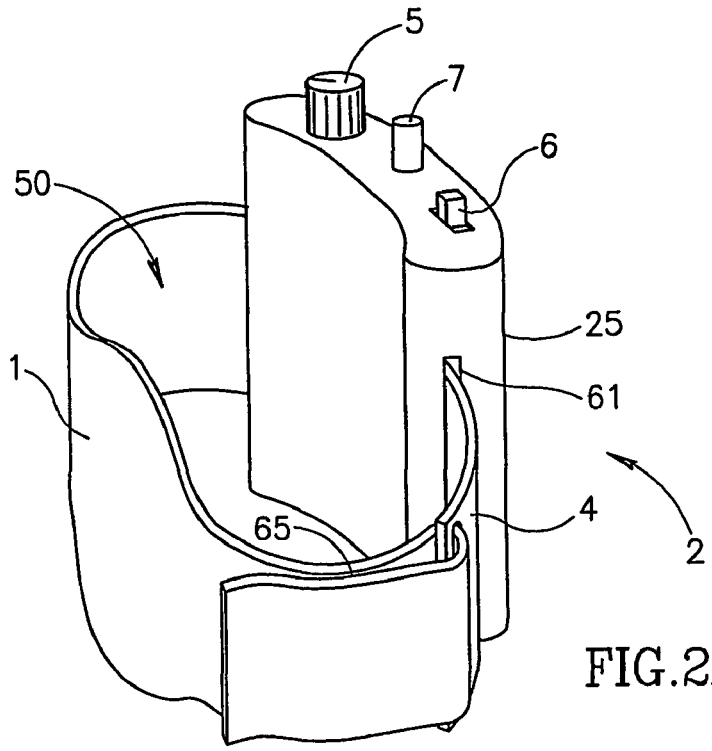
FIG. 2A is a side external view of a preferred anterior box embodiment of the present device, in which squeezing the limb muscles is performed by intermittent shortening the circumference of a loop created by an assembly body and strap.

FIG. 2 illustrate two possible embodiments of the device of the present invention. FIG. 2A represents a preferred embodiment of the present device, in which squeezing the limb muscles for promoting the increase of blood and lymph flow in the limb, is performed by pulling and releasing strap 1, thus, intermittently shortening the effective length of loop 50 encircling the limb. This embodiment is preferably used as an anterior box embodiment of the present invention. However, it will be easily appreciated that the device of FIG. 2A can be used as a posterior box embodiment as well.

Figure 2B:
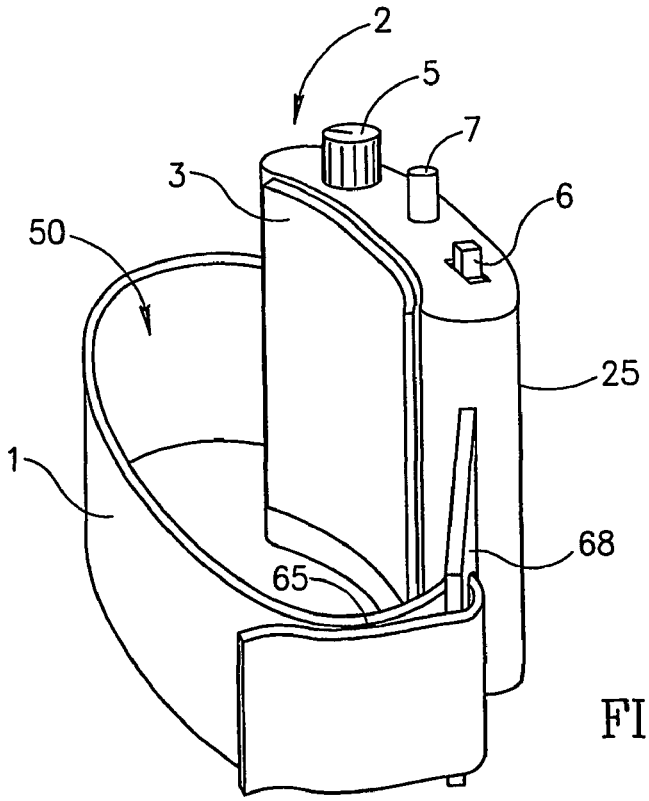
FIG. 2B is a side view illustration of an posterior box embodiment in which the assembly box is the active intermittent compressing part placed against the calf muscles.

FIG. 2B presents another embodiment of the present device in which assembly box 2 is the active intermittent compressing part by means of mobile plate 3 attached to the box. This embodiment, which can be used only as a posterior box embodiment, will be explained in conjunction with FIG. 6.

Turning back to FIG. 2A, assembly box 2 comprises a thin, curved flask-shaped casing 25 which contains all the parts of internal machinery responsible for intermittent pulling and releasing strap 1. Casing 25 is preferably fabricated from, but not limited to, a plastic molding, a light metal, or any other material which is light, non irritating to the skin, and cheep to produce.

Strap 1 is connected at both its ends to assembly box 2 by means of two buckles 4 and 42 at the sides of casing 25 (buckle 42 not shown). At least one of said buckles (here buckle 4) is a mobile buckle, which can move in and out of casing 25 through slit (opening) 61, thus pulling and relaxing strap 1 between a retracted and a relaxed positions. The retraction protraction motion shortens and lengthens the effective length of strap 1, thus causing intermittent compression of the underlying muscle and increasing the blood and lymph flow in the underlying vessels. Possible inner machinery responsible for activating the intermittent pulling of strap 1 is described in the following in conjunction with FIGS. 3 to 6.

Strap 1 can be adjusted to fit the size of the limb, on which device 100 is to be operated, by having at least one of its ends free to move through its corresponding buckle, such that the strap can be pulled by said end for tightening the strap around said limb. Said end is then anchored in the appropriate position. In the example shown here, the strap is folded back on itself and the overlapping areas are fastened to each other by fastening means 65, such as Velcro™ strips, snap fasteners or any other fastening or securing means. Alternatively, said strap end can be secured to casing 25 by fastening means such as Velcro strips, opposite teeth-like protrusions both on casing 25 and on strap 1, and the like.

The second end of strap 1 can be connected to its corresponding buckle either in a permanent manner by attaching means such as knots or bolts, or can be adjustable in a similar manner to what had been described above, allowing both ends to be pulled and anchored simultaneously for better fitting.

Yet, in accordance with another embodiment of the invention, the strap can be wound around a retracting mechanism positioned at one side of casing 25. The free end of the strap can be provided with a buckle for allowing connection into the opposite side of casing 25 either by one of the aforementioned means described or by means of a quick connector.

Outer casing box 25 also includes an on/off switch 6, a force regulator 5 for regulating the force exerted on the calf muscle by strap 1 and a rate regulator 7 for regulating the frequency of intermittent compressions. Alternatively, force regulator 5 and on/off switch 6 can be combined into one button. Force regulation can be obtained for example by way of controlling the length of the strap interval between retracted and protracted positions. The length interval between contracted and relaxed positions is preferably, but not limited to, 1-50 millimeters. Frequency regulation can be obtained by way of regulating, but not limited to, the speed of the inner machinery.

A person skilled in the art will readily appreciate that the present invention can be used for the enhancement of both arterial and venous blood and lymph flow in a limb (upper and lower). The examples provided in the following discussion serve as an example and should not be construed as a limitation to the application of the preset invention.

Figure 3A:
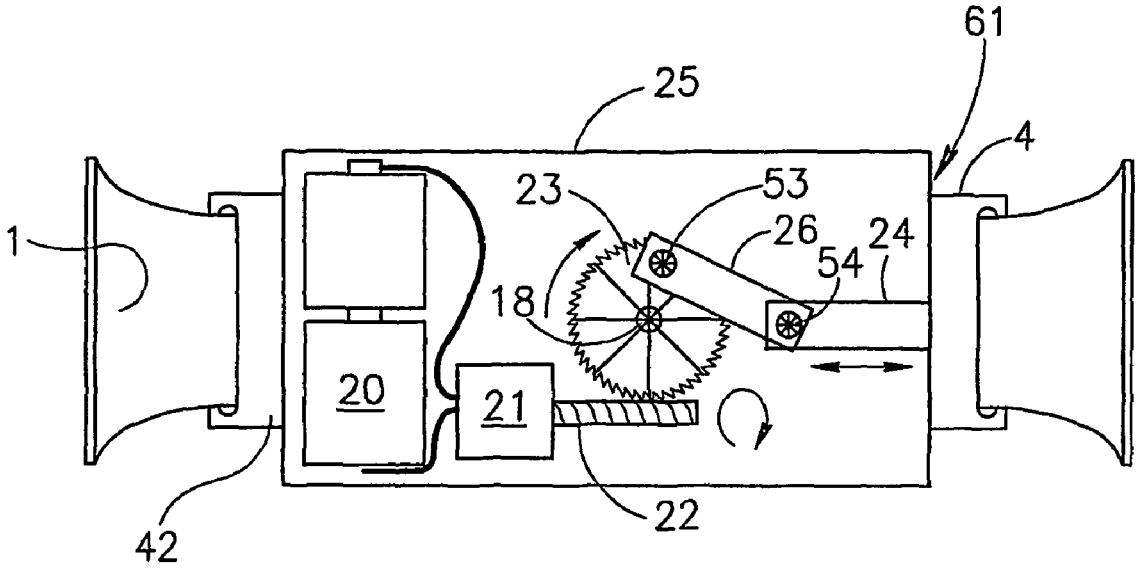
FIG. 3A is a cross section of a device in accordance with the embodiment of FIG. 2A, showing a first internal mechanism of the assembly box.
Figure 3B:
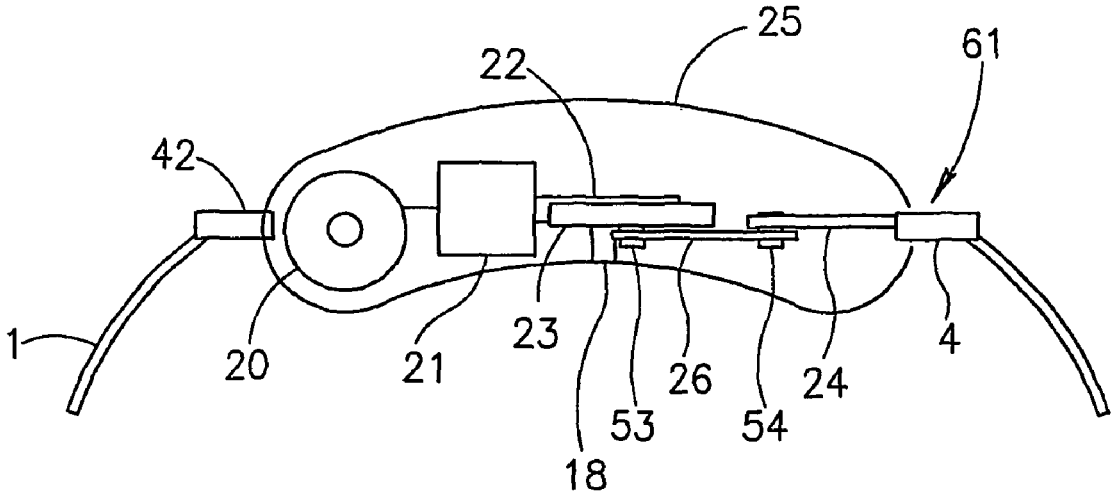
FIG. 3B is a top view of the device of FIG. 3A.

Referring now to FIGS. 3A and 3B, there is shown a side view and a top view respectively of first inner machinery for the device of FIG. 2A. The numerical are corresponding in both drawings. According to this embodiment, one end of strap 1 is connected to assembly box 2 via a fixed fitting 42 by means such as bolts, knots glue, etc. The second end is connected via a movable buckle 4, which traverses slit 61 located at the side of casing 25. Buckle 4 can retract and protract through opening 61, as described above. Movable buckle 4 is connected to the inner machinery by means of attachment to a rigid push/pull rod 24

The inner machinery responsible for the motion of movable buckle 4 is herein described.

An energy source 20 such as low voltage DC batteries, supplies electrical energy to an electrical motor 21 such as, but not limited to, a 3-12 V DC motor, via electrical contacts such as wires.

Electric motor 21 converts electric energy into kinetic energy, spinning a spirally grooved (worm) central shaft 22. Shaft 22 is coupled to a (speed reduction) wheel 23, having complementary anti-spiral circumferential grooves or teeth, causing wheel 23 to revolve around its center which is fixed by axis 18 perpendicular to its surface. An elongated connector plate 26 is pivotally jointed at one end to off-center point 53 on wheel 23 and at its second end to rod 24 at point 54, such that the rotation of wheel 23 actuates plate 26 to intermittently push and pull rod 24, in a crankshaft manner. Consequently, mobile buckle 4 is intermittently pulled inward and outward casing 25 through slit 61, thus intermittently shortening the circumference of loop 50.

Figure 3C:
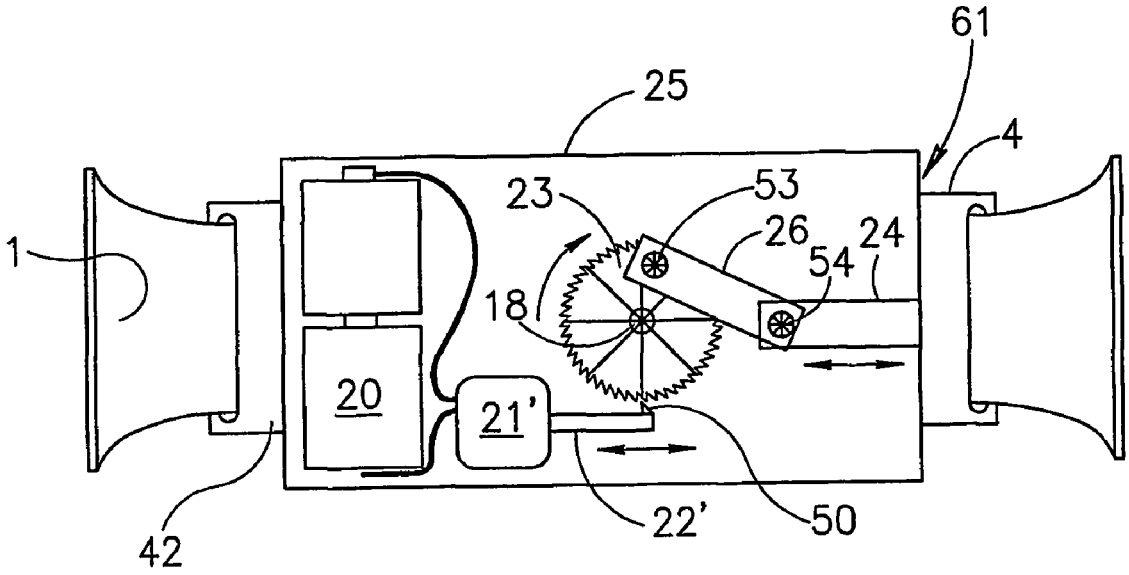
FIG. 3C depicts a modified mechanism of the embodiment of FIGS. 3A and 3B.

A modified machinery, represented in FIG. 3C, includes the following changes with reference to FIGS. 3A and 3B. The electric motor 21 and spinning worm shaft 22 are replaced with an electromagnetic motor 21' (such as a push-pull solenoid 191C distributed by Shindengen electric Ltd.) having a reciprocating central rod 22' with an upwardly inclined spike-tooth projection 50 at its end. Rod 22', via projection 50 is coupled to wheel 23, having complementary teeth. As reciprocating rod 22' slightly protrudes from, and retracts into the motor body, projection 50 latches sequential teeth of wheel 23 as it protrudes and pulls wheel 23 as it retracts, causing wheel 23 to revolve around its axis. The mechanism of FIG. 3C generates a large force output while minimizing the power input. Such a machinery is very cost effective.

The above description clearly shows how the internal mechanical machinery of the proposed device acts to intermittently shorten loop 50, culminating in intermittent compression of the leg or hand muscle and leading to increase of venous return and helping in the prevention of the formation of deep vein thrombosis.

Figure 4A:
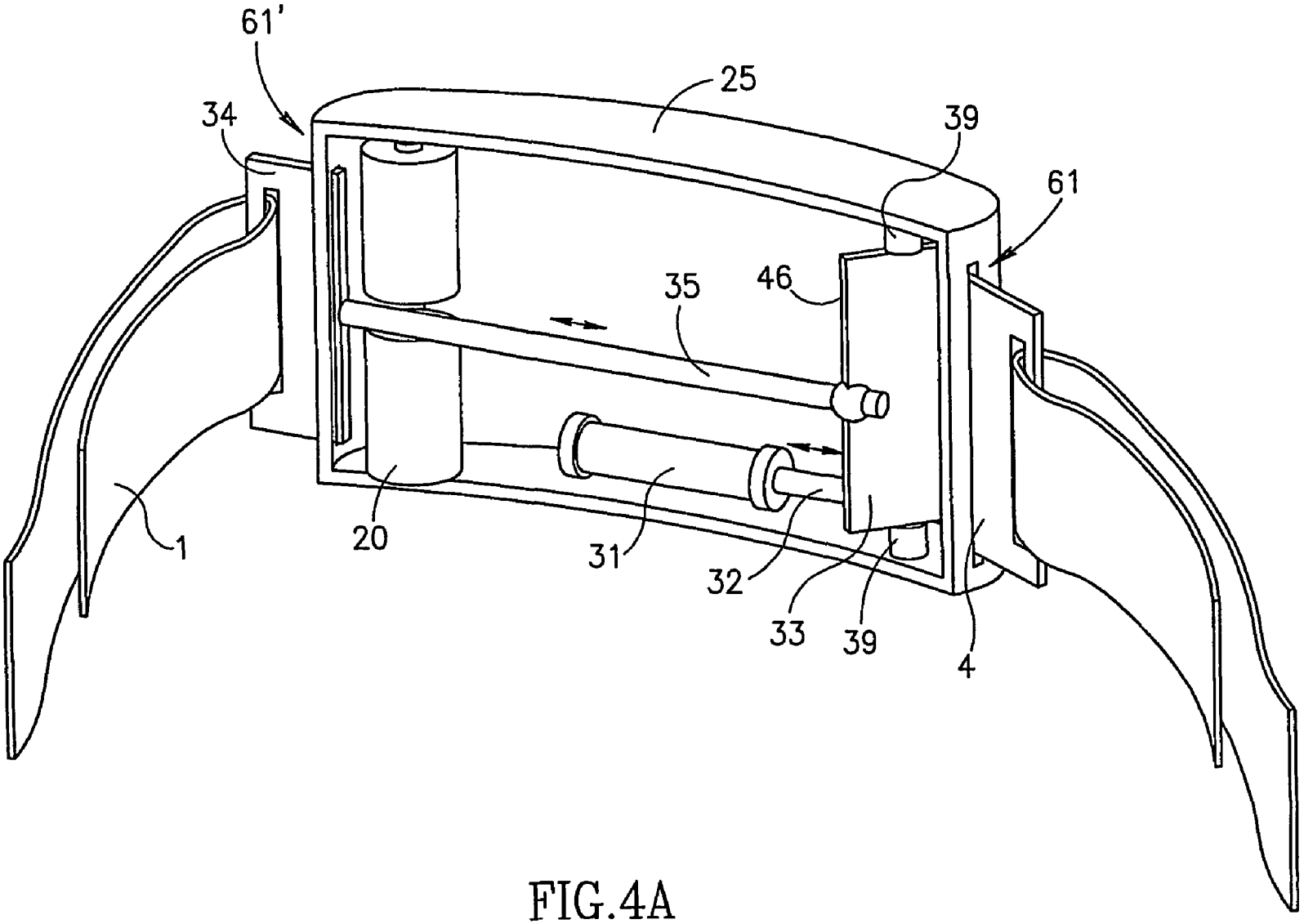
FIG. 4A is pictorial representation of an alternative mechanism for the embodiment of FIG. 2A using electromagnetic motor, a centrally hinged rotating rectangular plate and a longitudinal bar connecting both sides of the strap.
Figure 4B:
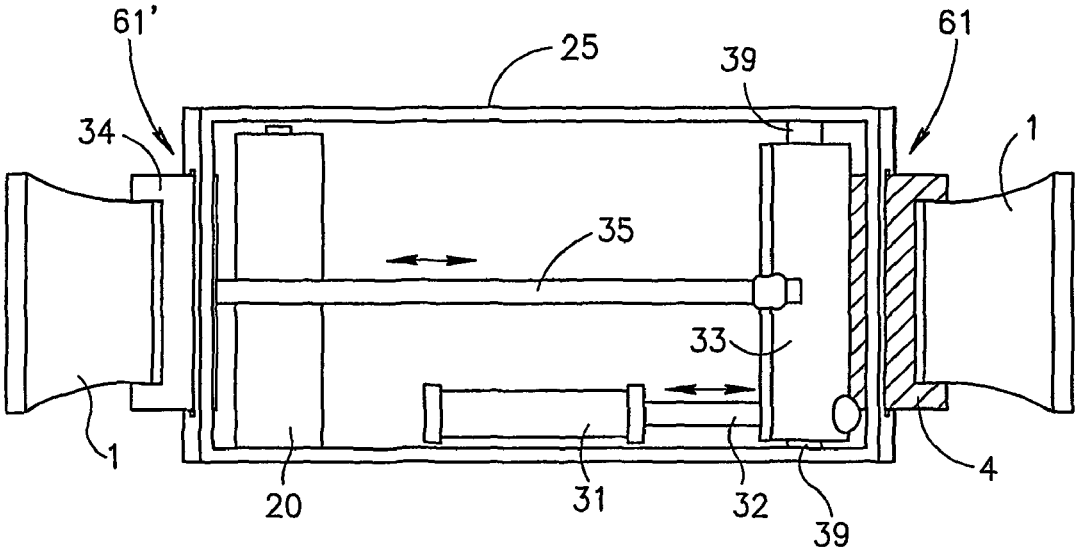
FIGS. 4B and 4C are side and top view respectively of the embodiment presented in FIG. 4A.
Figure 4C:
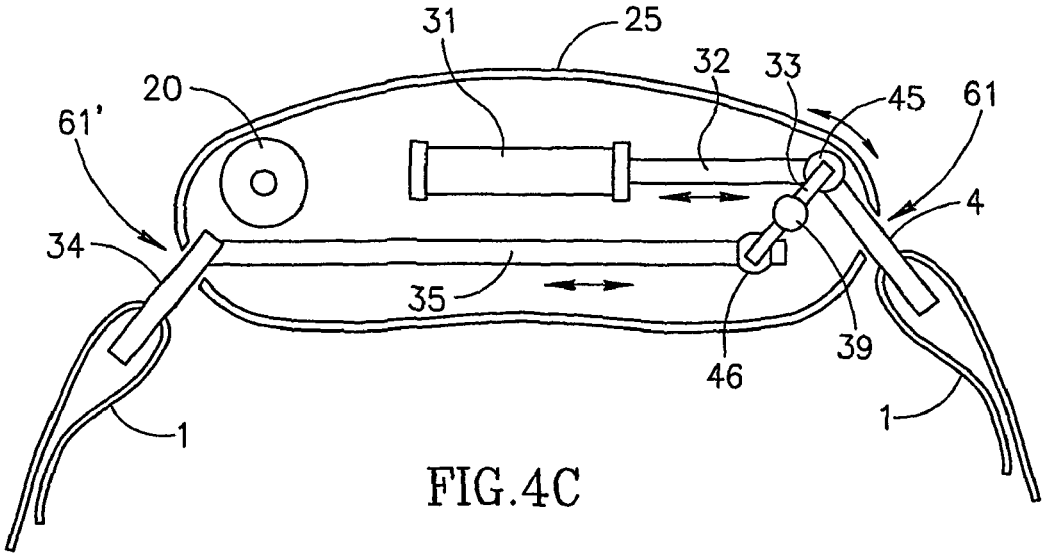

An alternative machinery embodiment for the device embodiment of FIG. 2A is shown in FIGS. 4A, 4B and 4C. FIG. 4A is a perspective drawing view showing the internal parts of assembly box 2 with the frontal part of casing 25 removed. FIGS. 4B and 4C side and top view, respectively of the embodiment shown in FIG. 4A. According to this embodiment, both ends of strap 1 are connected to the inner machinery of assembly box 2 by means of two movable buckles 4 and 34, which can move inwardly and outwardly casing 25 through slits 61 and 61', respectively.

This alternative embodiment combines the following elements:

A rectangular plate 33 positioned close to one side wall of casing 25, adjacent to slit 61. Plate 33 having two parallel rectangular surfaces, two narrow vertical edges, designated 45 and 46, and two narrow horizontal edges. Plate 33 is pivotally mounted at its narrow horizontal edges to the top and bottom walls of casing 25, by pivoting means 39, such as to allow rotational movement of the plate around the vertical axis connecting between pivoting means 39;

A push-pull electromagnetic motor 31 (such as pull tubular solenoid 190 distributed by Shindengen electric Ltd.) connected via its reciprocating central rod 32 to one vertical edge (45) of the centrally hinged rectangular plate 33, at about mid point of said edge;

A longitudinal rod 35 spans the length of casing 25. Said longitudinal rod 35 is connected at one end to the opposite vertical edge (46) of plate 33 and at its second end to movable buckle 34 positioned at the other side of casing 25.

Centrally hinged rectangular plate 33 is thus connected on one side to the electromagnetic motor 31 via central rod 32, and on the other side to longitudinal rod 35 (as best seen in FIG. 4C). Movable buckle 4 is also connected to narrow edge 45 of plate 33 but extends outwardly, through slit 61, in the opposite direction to rods 32 and 35.

As can be best seen in FIG. 4C, the reciprocating movement of rod 32 causes plate 33 to turn back and forth around its central axis, preferably the angular displacement is in the range of 20 to 60 degrees. Consequently, buckles 4 (coupled directly to plate 33) and 34 (by means of connecting rod 35) are synchronously pulled and pushed inward and outward of casing 25, resulting in intermittent shortening of the limb encircling loop.

This embodiment is advantageous because the longitudinal rod 35 allows both buckles 34 and 4 to approximate each other at the same time, thus enhancing the efficiency of the device (by enhancing the reciprocating displacement of electromagnetic motor 31) and requiring less energy.

Figure 5A:
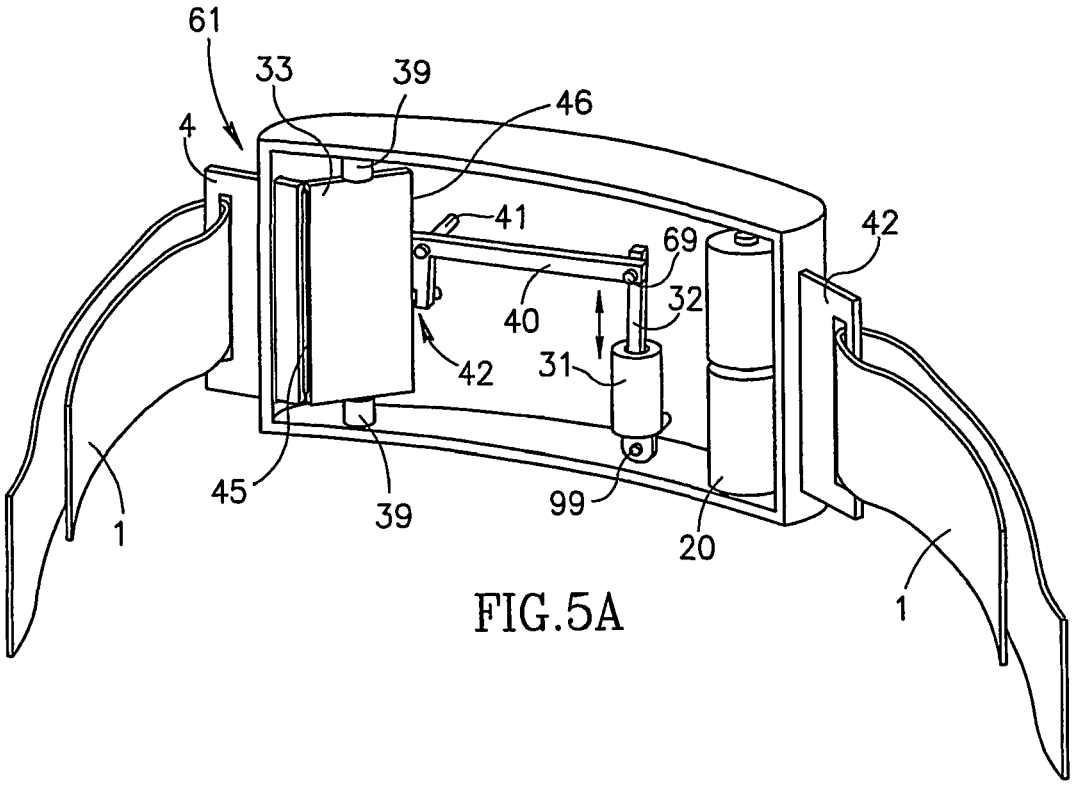
FIGS. 5A and 5B depict yet another mechanism for the embodiment of FIG. 2A using an enhanced power transmission by means of an "L" shaped lever bar.
Figure 5B:
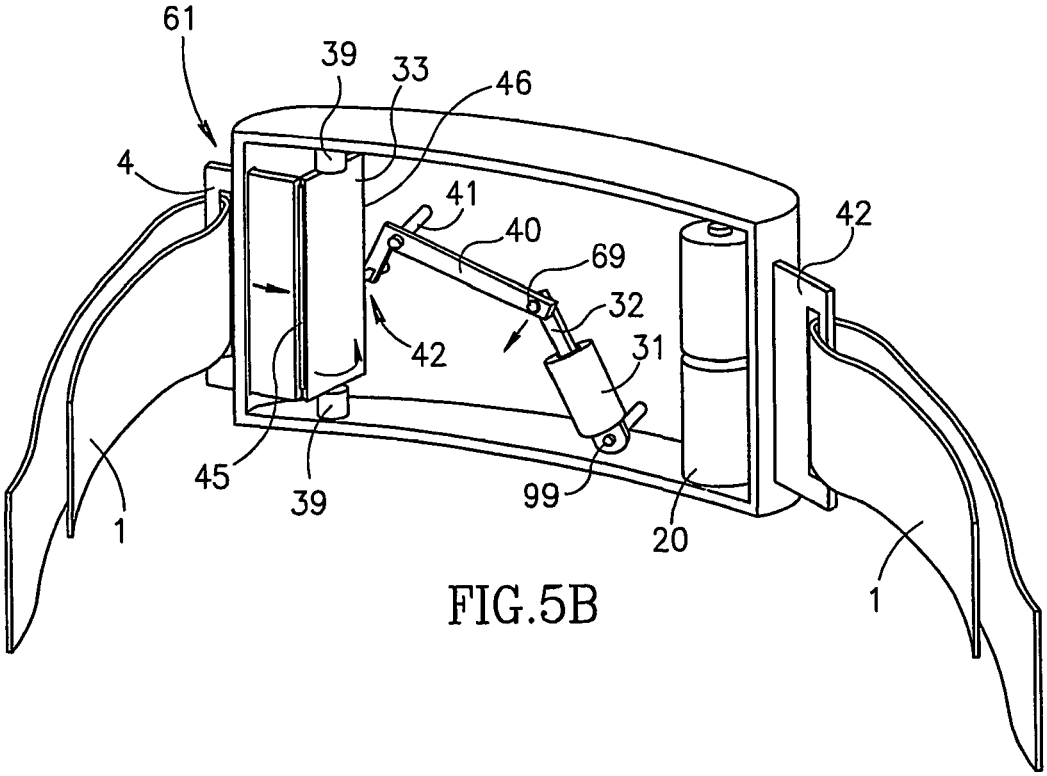

FIGS. 5A and 5B illustrate yet another alternative machinery for the device embodiment of FIG. 2A. The embodiment of FIG. 5 also uses a pull-push electromagnetic motor as the driving force but allows force enhancement by the addition of an "L" shaped lever bar 40 to the said centrally displaced rod 32 of the embodiment shown in FIG. 4. According to this embodiment, one edge of strap 1 is connected to fixed buckle 42 while the second end is connected to movable buckle 4 which transverse casing 25 through side slit 61. The movable buckle 4 is connected to centrally hinged rectangular plate 33 in a similar manner to what have been described in conjunction with FIG. 4.

In accordance with the present embodiment, electromagnetic motor 32 is pivotally mounted at its rear end to the base by pivoting means 99. The "L" shaped lever bar 40 pivotally mounted at its longer arm end to reciprocating rod 32 by pivoting means 39, and at its shorter arm end is attached to narrow edge 46 of plate 33, by attaching means 42, in a manner which allows it to slide up and down said edge. Such attaching means can be obtained, for example, by railing means such as a groove engraved along the edge of the short arm of lever 40 and a matching protruding railing extending from narrow edge 46 of plate 33. The right-angled corner of "L" shaped bar 40 is pivotally anchored to casing 25 by means of axis 41 perpendicular to the bar surface.

FIG. 5A represents the "relaxed" mode (i.e., buckle 4 in protracted position), while FIG. 5B is in a "contracted" mode (buckle 4 in retracted position). To understand the action of this embodiment a static description of the "relaxed" mode followed by the "contracted" mode description is herein given.

The "relaxed" mode in FIG. 5A, illustrates the electromagnetic motor 32 at a perpendicular position to the base of casing 25, and "L" shaped lever 41 in a perpendicularly positioned to reciprocating rod 32.

The "contracted" mode is shown in FIG. 5B. When reciprocating rod 32 retracts into electromagnetic motor 31, it causes the "L" shaped to rotate around axis 41, such that connection 69 moves toward electromagnetic motor 31 as well as toward the rectangular plate 33. This rotation is allowed due to pivot attachment 99 of electromagnetic motor 31 and pivot attachment 41 of "L" shaped lever bar 40. The other end of the "L" shaped lever bar 41 slides in the upward direction on edge 46 of rectangular plate 33 and at the same time it pushes plate 33 causing it to rotate counterclockwise such that edge 45 and consequently buckle 4 are drawn deeper into casing 25.

When reciprocating rod 32 reciprocates its motion, "L" shaped bar 41 returns to its "relaxed" perpendicular position (FIG. 5A) and consequently edge 45, along with buckle 4 are pushed outwardly.

Thus, this chain of events leads to an effective intermittent shortening of the limb encircling loop (50) and to an intermittent compression of the underlying muscle enhancing the blood flow.

Figure 6:
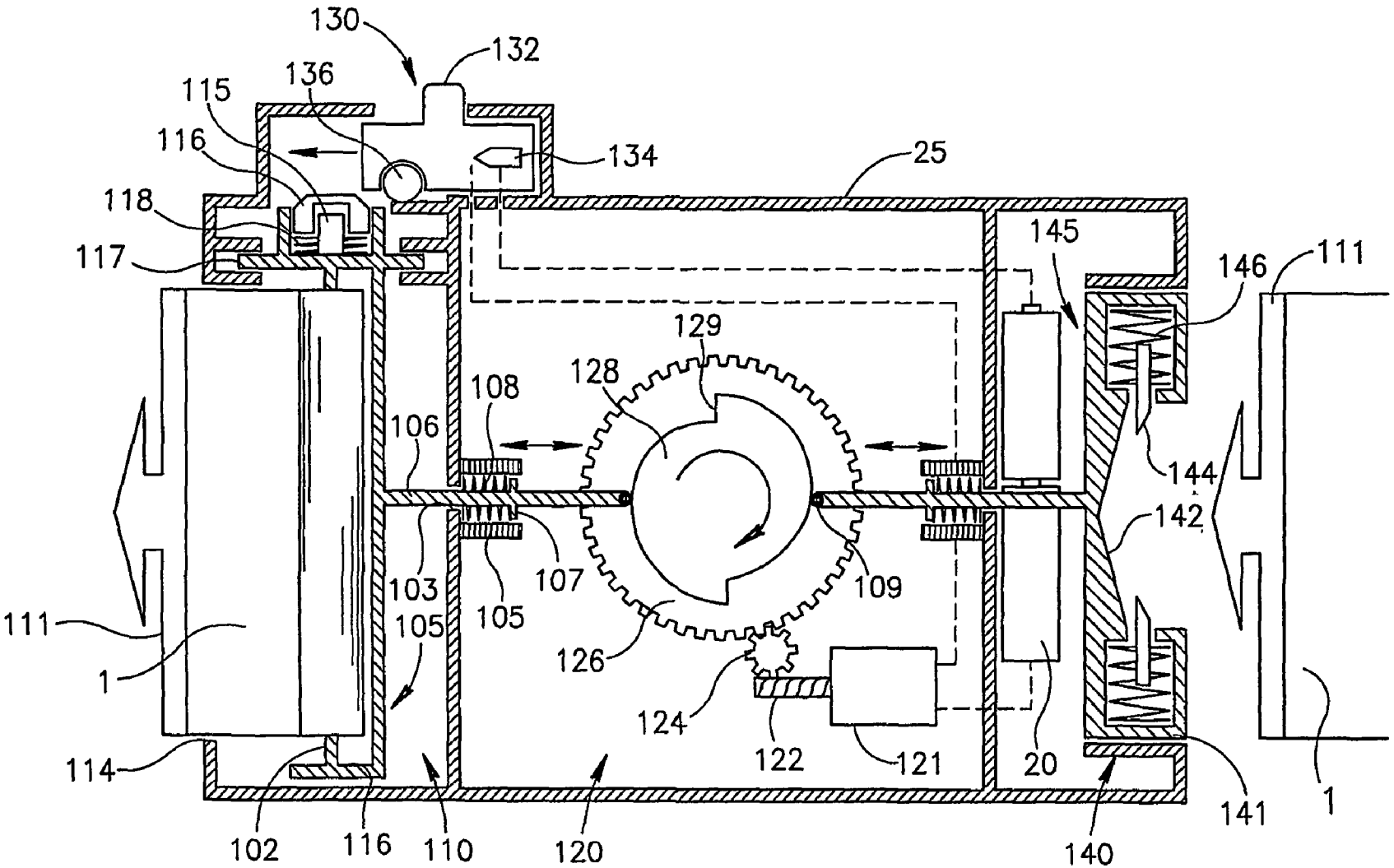
FIG. 6 is a side view of yet another embodiment of a device in accordance with the present invention.

FIG. 6 illustrates yet another preferred embodiment of the present invention, including means for allowing asymmetrical contraction-relaxation cycle and in particular for allowing fast contractions, followed by much longer periods of relaxation. Such a cyclic pattern is found to have the most beneficial effect for enhancing blood and lymph flow. In accordance with this embodiment, the machinery components responsible for intermittent pulling and releasing strap 1 comprises a motor 121 having a worm shaft 122, a speed reducing gear comprising wheels 124 and 126, coupled to shaft 122, and a disk 128 of irregular perimeter, concentrically mounted on wheel 126. Double-tooth disk 128 is shaped as two identical halves of varying curvature radius, each having a gradual slope at one end and a cusp 129 where the radius changes abruptly from maximum to minimum at its second end, wherein between two ends the radius of curvature is almost constant. The machinery components, including motor and wheels, are accommodated in a central compartment 120 of casing 25.

Two side compartments, 110 and 140, accommodate laterally movable strap connectors 105 and 145, respectively. Compartments 110 and 140 are provided with side slits 114 and 141, through which strap 1 can slide in and out. In accordance with the embodiment shown here, strap 1 is retractably mounted at one side of casing 25 (compartment 110) and having its free end provided with a quick male connector for connecting into complementary female connector in compartment 140. This strap fastening arrangement allows for quick and simple adjustment of the strap to the size of the limb and for exerting primary pressure on the muscles. Accordingly, connector 105 includes a vertical rod 102 rotatably mounted between two horizontal beams 116 and 117, allowing rod 102 to revolve around its axis for rolling/unrolling strap 1. Strap 1 is affixed to rod 102 at one end and is wound around the rod. Rod 102, acting as a spool for strap 1, is provided with a retraction mechanism (not shown). The retraction mechanism can be any spring loaded retracting mechanism or any other retraction mechanism known in the art, such as are used with seat belts, measuring tapes and the like. For example, the retraction mechanism can comprise a spiral leaf spring having one end secured to rod 102 so as to present torque on the rod when strap 1 is withdrawn and to cause the strap to roll back once its free end is released. The upper end of rod 102 terminates with head 115 and a cap 116 of a larger diameter mounted on springs 118. The inner surface of cap 116 fits onto outer surface of head 115, such that when cap 115 is pressed downward, it locks head 115, preventing free rotation of rod 102 and consequently preventing strap 1 from being rolled or unrolled. The second free end of strap 1 terminates with buckle 111 which fits into a complementary accepting recess 142 of connector 145 for allowing quick connection into the second side of casing 25. In the example illustrated here, buckle 111 has an arrow shape while connector 145 has a complementary arrow shape recess 142 provided with slanted protrusions 144 mounted on springs 146. When buckle 111 (duplicated on the right side of FIG. 6 for description sake only) is pushed toward recess 142, protrusions 144 are pressed aside, then fall behind the arrow head of buckle 111, locking the buckle.

Movable connectors 105 and 145 are coupled to the machinery components by means of horizontal rods 106, which extend through openings 103 into central compartment 120 and are in contact with disk 128 perimeter. Horizontal rods 106 terminate with bearings 109 which allow the rods to smoothly slide along disk 128 perimeter as the disk revolves around its axis. Thus, the distance between rods 106, and consequently the periodical change of the circumference of the loop encircling the limb, mimics the outline shape of disk 128. In order to maintain constant contact between bearings 109 and disk 128 and to facilitate fast transition between strap relaxed to contracted position, rods 106 are mounted on biasing springs 108 positioned between walls 105 and are provided with plates 107 perpendicular to the rod axis and pressed against springs 108. Thus, springs 108 bias connectors 105 and 145 in the inward direction toward each other. As disk 128 revolves around its axis, springs 108 are compressed by plates 107 in accordance with disk 128 varying radius. When disk 128 rotates to the point where cusps 129 simultaneously face bearing 109, rods 106 momentarily lose contact with disk 128 and the potential energy stored in springs 105 is released, pushing rods 106 inwardly. This causes a sudden inward pulling of strap 1 by both rods 106, leading to sharp squeezing of the limb muscles. It will be easily realized that the length interval between contracted and released states of the limb encircling loop, and hence the squeezing force exerted on the muscles, is directly proportional to the radius change at cusp 129. Following the sudden strap contraction, the rods are gradually pushed outwardly leading to strap relaxed mode which lasts for substantially half a cycle. Hence, one revolution of disk 128 around its axis results in two fast strap contractions. Typically, the transition from relaxed to contacted position takes about 0.5 seconds, the transition from contracted to relaxed position takes about 5 seconds and the relaxed position is maintained for about 50 seconds. However, it will be easily realized that the perimeter of disk 128 can be shaped such as to obtain any desired contraction-relaxation cyclic pattern.

The device is further provided with an on/off switch 130 comprising button head 132, electrical connector 134 made of electric conductive material, and a bottom protrusion 136. When switch 130 is pushed to the left by means of head 132, connector 134 closes the electric circuit (shown in broken line), setting the machinery into action. Simultaneously, protrusion 136 presses cap 116 downward, locking head 115 and preventing rod 102 from turning around its axis, for fixing the available length of strap 1. Button 132 can be further provided with a force regulator for regulating the frequency.

A different embodiment of the present invention in which box assembly 2 is the active intermittent compressing part is depicted in FIG. 2B. According to this embodiment, assembly box 2 further comprises a compressing plate 3 lying substantially parallel to casing 25 at a predetermined distance from its surface. According to this embodiment, the assembly 2, more specifically said compressing plate 3 is pressed against the muscle and intermittently extend and retracts from casing 25 thus producing intermittent compression of the calf muscle.

According to this embodiment strap 1 is connected to casing 2 by two fixed slited latches, such that at least one end of strap 1 is threaded through one of latches 68 and is folded onto itself to allow comfortable fitting, as described in conjunction to FIG. 2B. An on/off switch 6, a power regulator 5 and a rate regulator 7 are located at the top of the device in the same fashion as in FIG. 2B.

Figure 7:
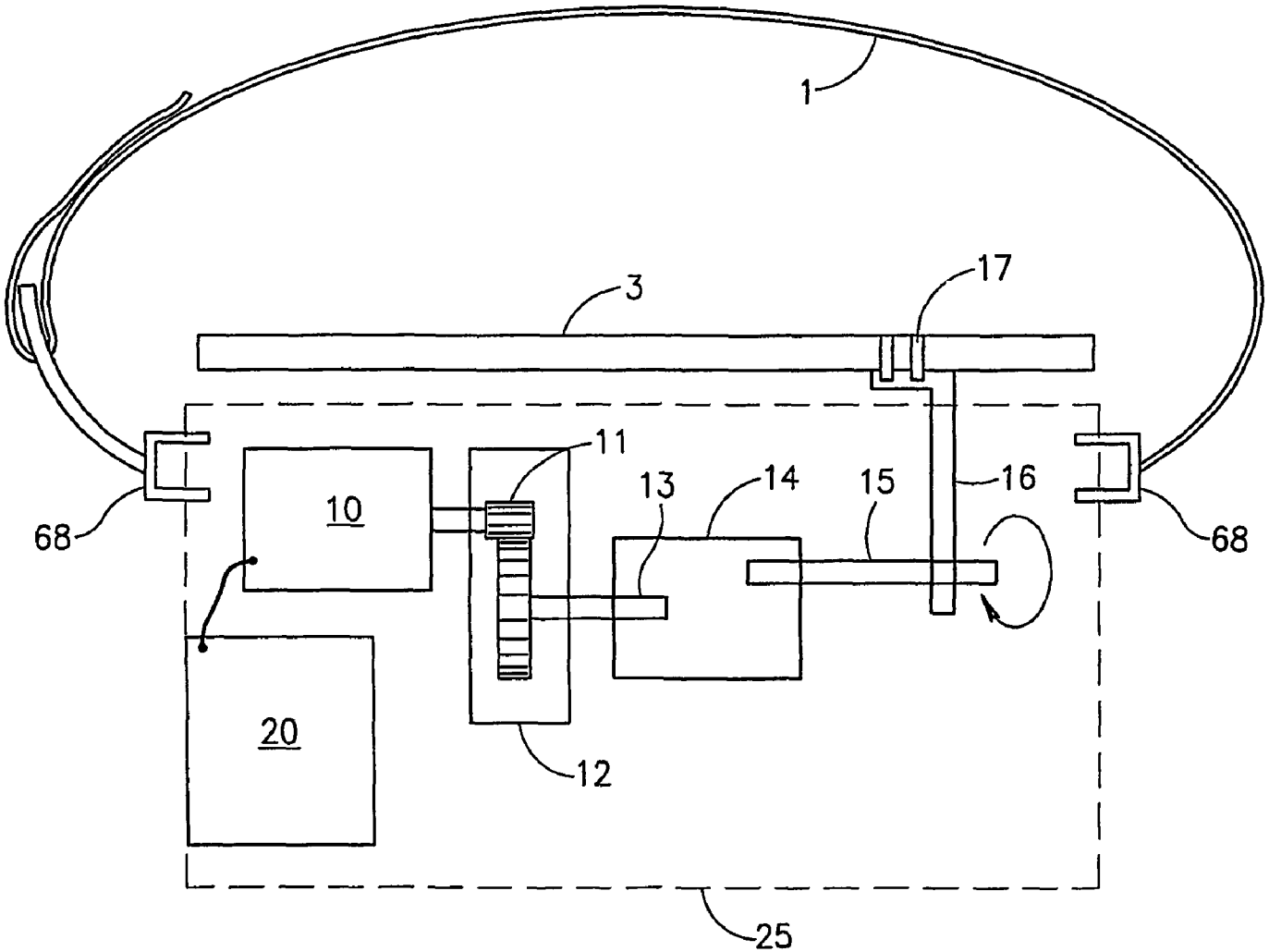
FIG. 7 is a top view of a device in accordance with the anterior box embodiment of FIG. 2B showing the internal mechanism of the assembly box.

A top view of a machinery embodiment in accordance with the device embodiment of FIG. 2B is shown in FIG. 7. A power source 20 powers an electrical motor 10 that has a centrally located shaft 11. Said centrally located shaft 11 is coupled to a velocity reduction gear 12 which reduces the spinning velocity of the rod 11 and increases the power output. Reduction gear 12 has a centrally located rod 13 that is connected to drum 14 that has an eccentric located rod 15. The eccentric located rod 15 is connected perpendicularly to the longer arm of a motion transfer L-shaped bar 16, wherein the shorter arm of said L-shaped bar 16 is connected to compressing plate 3 by connection means 17. Connection means 17 may be for example bolts, pins, screws etc.

Electrical motor 10 converts electrical energy into kinetic energy stored in the spinning of the centrally located rod 11. The kinetic energy stored in the spinning of the said centrally located rod 11 is converted into power by the said velocity reduction gear 12. The power stored in the said centrally located rod 13 connected to the said velocity reduction gear 12 is converted to the rotation of the said drum 14 which has the said fitted eccentrically located rod 15. The circular motion of the said eccentrically located rod 15 is transferred to the extension and retraction of the said compressing plate 3 via the said motion transfer rod 16 and connection means 17.

According to this arrangement, the circular motion of the eccentrically located rod 15 is transferred into periodical motion of plate 3. Said periodical motion of plate 3 is a combination of a first periodic motion in the extension-retraction direction (i.e., increasing and decreasing the distance between plate 3 and casing 25) as well as a second periodic motion which is perpendicular to said first periodic motion. (In accordance with FIG. 6, this second periodic motion is in a direction perpendicular to the drawing surface).

Thus, further to the obvious effect of applying intermittent compression on the limb by the extension-retraction motion of plate 3, the present embodiment also imparts the device a "massage-like" effect, thus enhancing the squeezing efficacy.

It will be easily realized by persons skilled in the art that the embodiments described in FIGS. 3-7 are only examples and that different features described separately in conjunction with a particular embodiment, can be combined in the design of a device of the present invention. For example, a retractable strap feature as illustrated in FIG. 6 can be combined with any of the other embodiments. Much the same, an asymmetrical component such as disk 128 of FIG. 6 can be added to any of the other embodiments for allowing a particular pattern of a contraction-relaxation cycle.

Figure 8:
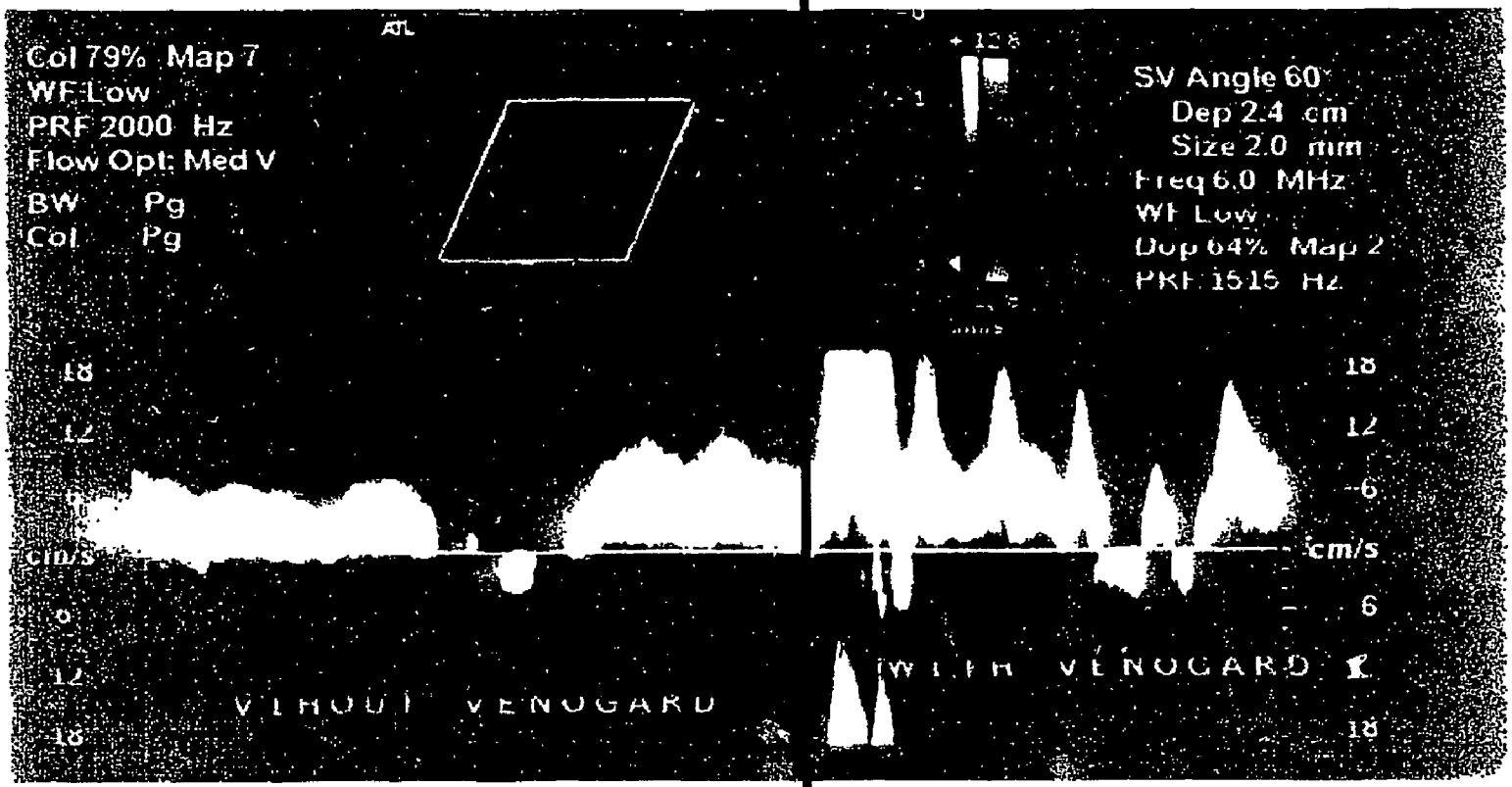
FIG. 8 shows exemplary Doppler ultrasound test results obtained by the application of the present invention.

FIG. 8 shows an exemplary Doppler ultrasound test results obtained by the application of the present invention. The results shown here were obtained by applying a device in accordance with the embodiment of FIG. 6 on a 49 years old healthy woman in the supine position. The device was applied to the right thigh close to the groin. The right side of FIG. 8 is a Doppler ultrasound measurement of the patient just before the activation of the said device. The white areas represent the blood flow in the deep veins of the thigh. These white areas are taken here as baseline for this subject. The blood flow in the deep veins of the same subject is illustrated in the left picture of FIG. 8 immediately after the said device was put to action. FIG. 8 clearly shows the immediate enhancement in the venous blood flow above the said baseline upon operation of the device as depicted by higher peaks of white areas. The above Doppler Ultrasound example displays the efficacy of the present device.

In addition to the examples shown above, it will be apparent to the person skilled in the art that the device of the present invention can be readily used for the enhancement of blood flow in many situations. Such include persons sitting or laying for long periods of time (for example, during long air flights or car travels or long hours working at the sitting position or immobilization at the hospital or rehabilitation center and the like.) It will be apparent that it may also be used for the enhancement of blood flow of a patient with diseases such as Diabetes Mellitus and Burger's disease. Also, for the enhancement of lymph flow in the hand of a patient post mastectomy. Other uses not described here above will be apparent to the person skilled in the art. Providing said examples is made for the purpose of clarity and not limitation.

The invention claimed is:

1. A portable limb squeezing device for therapeutically modifying circulation in a limb comprising a non-inflatable strap adapted to form a hold around a limb and a limb-carried actuator connectable to said strap adapted to repeatedly pulling and releasing said strap, thereby applying repetitive intermittent squeezing forces on said limb, wherein said actuator comprises at least one spring for allowing storage of energy.

2. The device of claim 1 wherein said intermittent squeezing forces are applied less than about every 5 minutes and more than about every 1 second to the limb of a user to generate a repetitive pressure change on said limb.

3. The device of claim 1 wherein said intermittent squeezing forces affect intermittent compression and relaxation of said limb.

4. The device of claim 3 wherein the intermittent squeezing forces are controlled such as to allow different compression and relaxation time periods.

5. The device of claim 3 wherein the intermittent squeezing forces are controlled such as to allow fast transition from relaxation to compression of the limb followed by a short duration of a compression and a longer duration of relaxation.

6. The device of claim 1 wherein said actuator comprises at least one element adapted for facilitating a quick transition between compression and relaxation of the limb.

7. The device of claim 1 wherein the device is an integral self contained device adapted to be mounted on the limb.

8. The device of claim 1 wherein the device comprises a frame and wherein the actuator and a power source for supplying power to the actuator are mounted on the frame.

9. The device of claim 1 wherein the intermittent squeezing forces are selected to enhance the arterial flow, or the venous flow or the lymph flow or a combination thereof in the limb proximal or distal to the device.

10. The device of claim 9 wherein the squeezing forces generate a temporary increase or decrease or a blockage in flow of blood or lymph fluid in the limb of the user of the apparatus.

11. The device of claim 1 wherein said limb is a leg and wherein said device is placed around the calf.

12. The device of claim 1 wherein the non inflatable strap is fabricated from a non-stretchable material, or a stretchable material, or a stiff material or flexible material, or a combination thereof.

13. The device of claim 1 wherein the non-inflatable strap is a retractable strap retractably mounted at one side of a frame and wherein said frame is mounted on the limb.

14. A portable limb squeezing device for therapeutically modifying circulation in a limb comprising a non-inflatable strap adapted to form a hold around a limb and a limb-carried actuator connectable to said strap adapted to repeatedly pulling and releasing said strap, thereby applying repetitive intermittent squeezing forces on said limb, wherein said actuator comprises at least one spring adapted for facilitating a quick transition between compression and relaxation of the limb.

15. The device of claim 14 wherein said intermittent squeezing forces are applied less than about every 5 minutes and more than about every 1 second to the limb of a user to generate a repetitive pressure change on said limb.

16. The device of claim 14 wherein said limb is a leg and wherein said device is placed around the calf.

17. A portable limb squeezing device for therapeutically modifying circulation in a limb comprising a non-inflatable strap adapted to form a hold around a limb and a limb-carried actuator connectable to said strap adapted to repeatedly pulling and releasing said strap, thereby applying repetitive intermittent squeezing forces on said limb, wherein the actuator comprises a mechanism coupled to at least one laterally movable connector connectable to the strap and wherein the mechanism intermittently changes positions of said at least one movable connector between an extended and a retracted positions.

18. The device of claim 17 wherein said intermittent squeezing forces are applied less than about every 5 minutes and more than about every 1 second to the limb of a user to generate a repetitive pressure change on said limb.

19. The device of claim 17 wherein said limb is a leg and wherein said device is placed around the calf.

20. The device of claim 17 wherein the intermittent squeezing forces are selected to enhance the arterial flow, or the venous flow or the lymph flow or a combination thereof in the limb proximal or distal to the device.

21. A portable limb squeezing device for therapeutically modifying circulation in a limb comprising a non-inflatable strap adapted to form a hold around a limb and a limb-carried actuator connectable to said strap adapted to repeatedly pulling and releasing said strap, thereby applying repetitive intermittent squeezing forces on said limb, and a regulator for regulating the frequency of said intermittent squeezing forces.

22. The device of claim 21 wherein said intermittent squeezing forces are applied less than about every 5 minutes and more than about every 1 second to the limb of a user to generate a repetitive pressure change on said limb.

23. The device of claim 21 wherein said limb is a leg and wherein said device is placed around the calf.

24. The device of claim 21 wherein the intermittent squeezing forces are selected to enhance the arterial flow, or the venous flow or the lymph flow or a combination thereof in the limb proximal or distal to the device.

25. A portable limb squeezing device for therapeutically modifying circulation in a limb comprising a non-inflatable strap adapted to form a hold around a limb and a limb-carried actuator connectable to said strap adapted to repeatedly pulling and releasing said strap, thereby applying repetitive intermittent squeezing forces on said limb, wherein the actuator comprises an electrical motor provided with a spinning shaft.

26. The device of claim 25 wherein the actuator further comprises a speed reducing wheel coupled to said motor and a crankshaft means coupled to said wheel and connected to the strap by means of a laterally movable connector for intermittently pulling and releasing said strap.

27. The device of claim 25 wherein said spinning shaft is a spinning worm shaft and wherein the actuator further comprises:

a speed reducing wheel coupled to said shaft;

a disk of an irregular perimeter centrically mounted on said speed reducing wheel; and at least one movable connector connectable to said non-inflatable strap, said connector is coupled to the perimeter of the disk so that when the disk revolves around its axis, the movable connector moves laterally between protracted and retracted positions in accordance with said irregular perimeter.

28. The device of claim 27 wherein the at least one movable connector is provided with an at least one spring for facilitating quick transition between said protracted and retracted positions, thereby actuating a sharp squeezing of muscles.

29. A portable limb squeezing device for therapeutically modifying circulation in a limb comprising a non-inflatable strap adapted to form a hold around a limb and a limb-carried actuator connectable to said strap adapted to repeatedly pulling and releasing said strap, thereby applying repetitive intermittent squeezing forces on said limb, wherein the actuator comprises an electromagnetic pull-push motor having a reciprocating rod.

* * * * *